United States Patent [19]

Oliff

[11] Patent Number: 5,060,792

[45] Date of Patent: Oct. 29, 1991

[54] CAN CARTON

[75] Inventor: James R. Oliff, Austell, Ga.

[73] Assignee: The Mead Corporation, Dayton, Ohio

[21] Appl. No.: 588,682

[22] Filed: Sep. 26, 1990

[51] Int. Cl.[5] ..... B65D 75/00

[52] U.S. Cl. ..... 206/140; 206/434; 206/427; 229/40

[58] Field of Search ..... 206/139, 140, 141, 193, 206/427, 434; 229/40

[56] References Cited

U.S. PATENT DOCUMENTS

| | | | |
|---|---|---|---|
| 2,296,228 | 9/1942 | Powell | 206/140 |
| 2,931,490 | 4/1960 | McGihon | 206/427 |
| 2,936,069 | 5/1960 | Dunning | 206/427 |
| 2,943,427 | 7/1960 | Fisher | 206/434 |
| 3,156,377 | 11/1964 | Wysocki | 206/140 |
| 3,963,121 | 6/1976 | Kipp | 206/434 |
| 4,216,861 | 8/1980 | Oliff | 206/427 |
| 4,440,340 | 4/1934 | Bakx | 206/140 |
| 4,773,540 | 9/1988 | Schuster | 206/140 |
| 4,804,089 | 2/1989 | Wilson | 206/140 |
| 5,000,313 | 3/1991 | Oliff | 206/434 |

FOREIGN PATENT DOCUMENTS

| | | | |
|---|---|---|---|
| 580540 | 7/1959 | Canada | 206/141 |

*Primary Examiner*—David T. Fidei

*Attorney, Agent, or Firm*—Rodgers & Rodgers

[57] ABSTRACT

A carton formed from a unitary blank for packaging a plurality of cans includes a top wall, side walls, foldably joined along their top edges respectively to opposite side edges of the top wall, a pair of lap panels foldably joined respectively to the bottom edges of the side walls and secured together in overlapping relation to form a composite bottom wall of the carton, an anchoring panel foldably joined to each end edge of each side wall and folded into flat face contacting relation with the inner surface of the associated side wall, masking structure for overlying the pricing indicia applied to individual cans, includes a masking panel foldably joined to each end edge of each lap panel and arranged with the inner edges thereof disposed in overlapping relation together with web structure foldably joined along one edge thereof to the adjacent edge of the associated anchoring panel and foldably joined along another edge thereof to the adjacent end of the associated masking panel.

7 Claims, 4 Drawing Sheets

CAN CARTON

TECHNICAL FIELD

This invention relates generally to packaging a plurality of primary packages within a secondary package such as a wrapper type enclosure and is specifically concerned with masking price indicating indicia which may be applied to individual primary packages so that correct pricing indicia applicable to the entire group of primary packages enclosed within the wrapper and applied to an exterior surface of the wrapper is effective to indicate correctly the price of the entire group of primary packages.

BACKGROUND ART

U.S. Pat. No. 4,545,476 issued Oct. 8, 1985 and owned by the assignee of the this invention is concerned with the same problem with which the present invention is concerned although the problem is solved according to U.S. Pat. No. 4,545,476 by mechanism which rotates individual cubical packages in such a manner as to prevent undesired and incorrect pricing of all of the primary packages within a wrapper due to exposure of pricing indicia on a single cubical package.

U.S. patent application Ser. No. 530,163 filed May 29, 1990 now U.S. Pat. No. 5,000,313 and owned by the assignee of this invention discloses a can carton of the wrapper type wherein the wrapper is especially formed so as to accommodate packaging of specially shaped primary packages and which in certain structural features is similar to the carton formed according to this invention.

SUMMARY OF THE INVENTION

According to this invention in one form, a carton is formed from a unitary blank for packaging a plurality of cans and includes a top wall, side walls foldably joined along their top edges respectively to opposite side edges of the top wall, a pair of lap panels foldably joined respectively to the bottom edges of said side walls and secured together in overlapping relation to form a composite bottom wall of the carton, an anchoring panel foldably joined to each end edge of each side wall and folded into flat face contacting relation with the inner surface of the associated side wall, a masking panel foldably joined to each end edge of each lap panel and arranged with the inner edges thereof disposed in overlapping relation at each end of the carton, and web structure foldably joined along one edge thereof to the adjacent edge of the associated anchoring panel and foldably joined along another edge thereof to the adjacent end of the associated masking panel.

BEST MODE OF CARRYING OUT THE INVENTION

Figure 1:
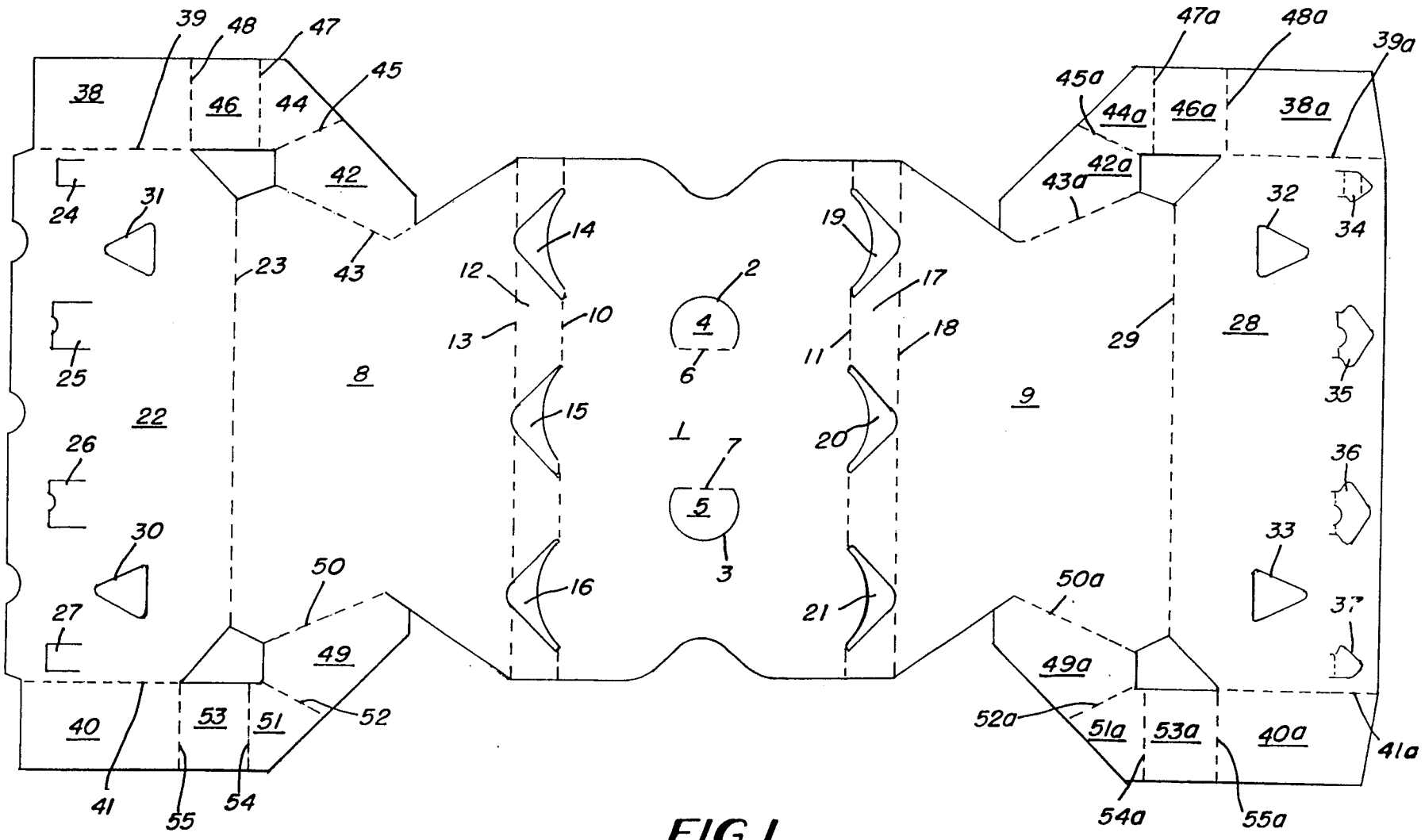
FIG. 1 is a plan view of a blank formed according to one form of the invention as viewed from the outside thereof.

With reference primarily to FIG. 1, the numeral 1 designates the carton top wall. A pair of known finger receiving apertures 2 and 3 are formed in top wall 1 and are normally closed by tabs 4 and 5 which are foldably joined to top wall 1 along fold lines 6 and 7 respectively.

Side walls 8 and 9 are foldably joined to top wall 1 along interrupted fold lines 10 and 11 respectively. Side wall 8 includes a bevel panel 12 which forms the top portion of side wall 8 and which is foldably joined to the lower portion of side wall 8 along fold line 13. Cutaway areas 14, 15 and 16 are formed in bevel panel 12 for receiving the upper portions of packaged cans in a manner well known in the art.

On the other side of the blank, bevel panel 17 forms the upper portion of side wall 9 and is foldably joined thereto along fold line 18. Apertures 19, 20 and 21 are formed in bevel panel 17 and receive the upper portions of packaged cans in a manner well known in the art.

Lap panel 22 is foldably joined to the bottom edge 23 of side wall 8. Retaining tabs 24, 25, 26 and 27 are struck from lap panel 22 and define apertures for receiving locking tabs formed in lap panel 28 foldably joined to the bottom edge of side wall 9 along fold line 29. Tightening apertures 30 and 31 are formed in lap panel 22 and similar tightening apertures 32 and 33 are formed in lap panel 28. As is well known in the art, machine elements enter tightening apertures and move in such manner as to tighten the wrapper about a group of articles to be packaged after which the carton is locked by driving locking tabs 34–37 through apertures defined by retaining tabs 24–27 so as to secure the blank about a group of cans.

In accordance with a principal feature of this invention, pricing indicia which may be formed on the outer surface of the wall of packaged cans and near the bottom thereof is rendered ineffective. Such structure includes a masking panel 38 foldably joined to lap panel 22 along fold line 39 together with masking panel 40 foldably joined to lap panel 22 along fold line 41.

For manipulating masking panel 38 into its set up condition, an anchoring panel 42 foldably joined to an end edge of side wall 8 along fold line 43 is provided together with web structure 44 foldably joined to anchoring panel 42 along fold line 45 and which in turn is foldably joined to generally rectangular panel 46 along fold line 47. Rectangular panel 46 is foldably joined to masking panel 38 along fold line 48.

For manipulating masking panel 40 in accordance with a feature of this invention, anchoring panel 49 is foldably joined to an end edge of side wall 8 along fold line 50 and is foldably joined to web structure 51 along fold line 52. A generally rectangular panel 53 is foldably joined to web structure 51 along fold line 54 and to masking panel 40 along fold line 55.

The masking structure formed according to this invention and which is associated with side wall 9 and lap panel 28 is identical to that associated with side wall 8 and lap panel 22. Such structure is identified by the same numerals as are used in connection with side wall 8 and lap panel 22 with the addition of the suffix "a".

Figure 2:
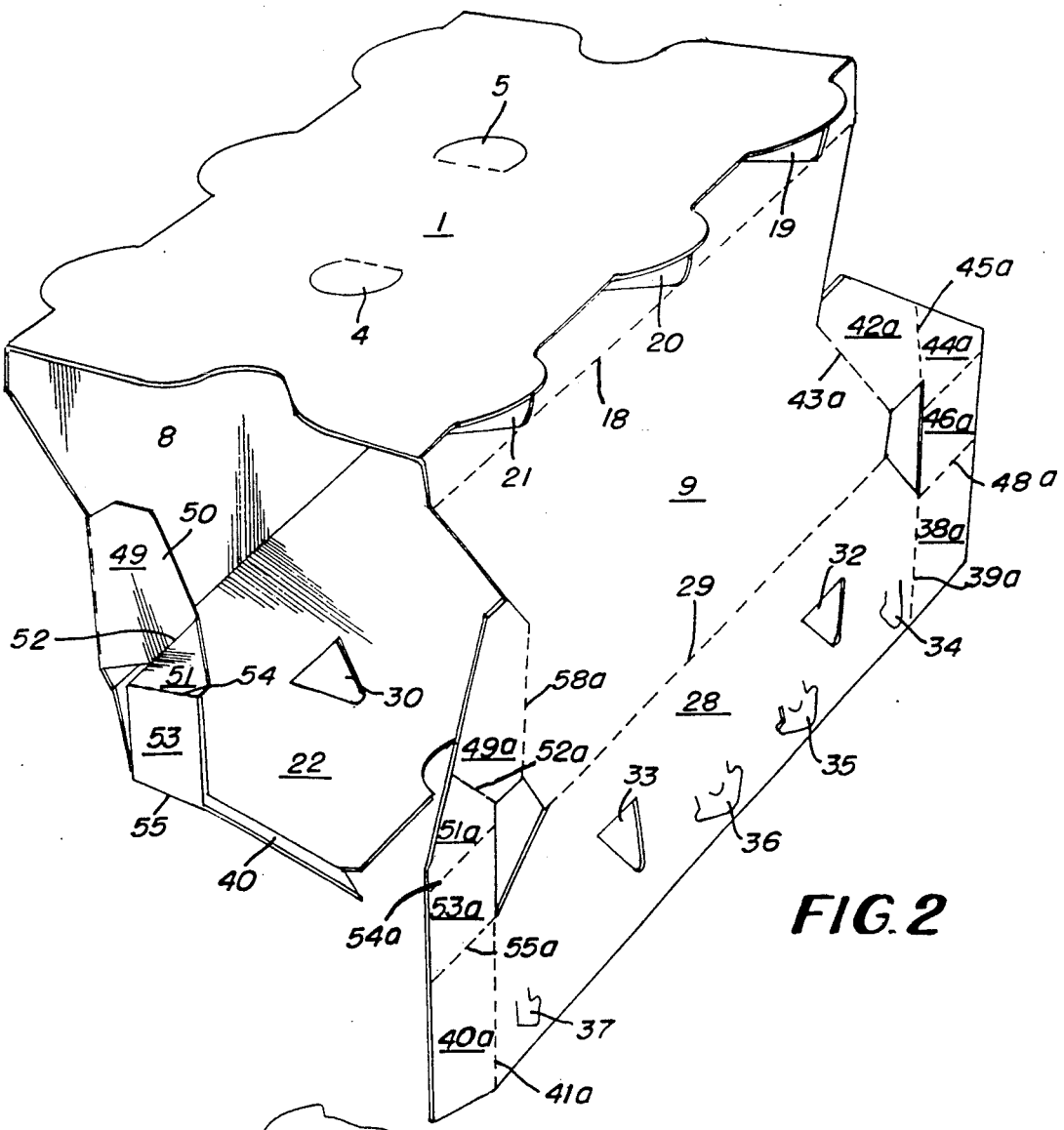
FIG. 2 is a perspective view of a carton being formed from the blank of FIG. 1 during an intermediate folding stage and with the packaged cans omitted for clarity.
Figure 3:
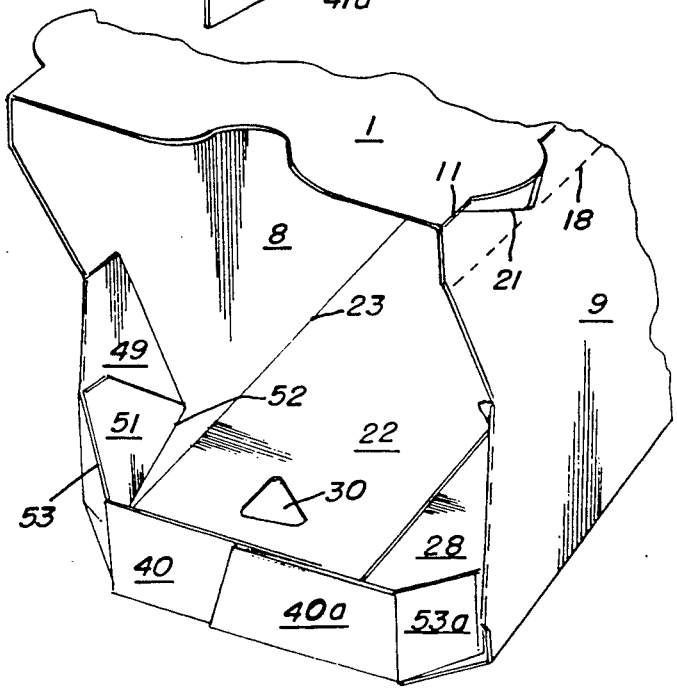
FIG. 3 is a perspective view of one end of the carton formed from the blank of FIG. 1 after the carton is completely formed and which eliminates the cans for clarity.

In order to form a package using the blank of FIG. 1, a group of primary packages such as six cans arranged in two rows of three cans each is formed and the blank is lowered onto the group of cans and arranged so that the upper edges of the cans are disposed within the apertures 19, 20 and 21 and corresponding apertures 14, 15 and 16 formed on the opposite side of top wall 1. Side walls 8 and 9 are then folded downwardly alongside the group of cans and the anchoring panel 49 is folded into flat face contacting relation with the inner surface of side wall 8 as indicated in FIG. 2. Web structure 51, generally rectangular panel 53 and masking panel 40 occupy the positions shown in FIG. 2 during this intermediate folding stage. Lap panel 28 and anchoring panel 49*a* are folded inwardly as are web structure 51*a*, generally rectangular panel 53*a* and masking panel 40*a* and are manipulated into the positions shown in connection with panels 49, 51, 53 and 40 in FIG. 2. When the folding operations are completed, web structures 51 and 51*a* are disposed in flat face contacting relation with anchoring panels 49 and 49*a*. Also the generally rectangular panels 53 and 53*a* are disposed astride the carton corners as shown in FIG. 3 and the inner ends of masking panels 40 and 40*a* are overlapped as shown in FIG. 3. This structure comprising masking panels 40 and 40*a* is located at the bottom of the package and thus is disposed so as to overlie and to isolate any pricing indicia from indicating devices that may have been applied to the lower parts of the cylindrical side walls of the primary packages. Thus appropriate pricing indicia which reflects the correct price of the entire package may be applied to the outer surface of lap panel 22 or 28 as may be desired.

Figure 4:
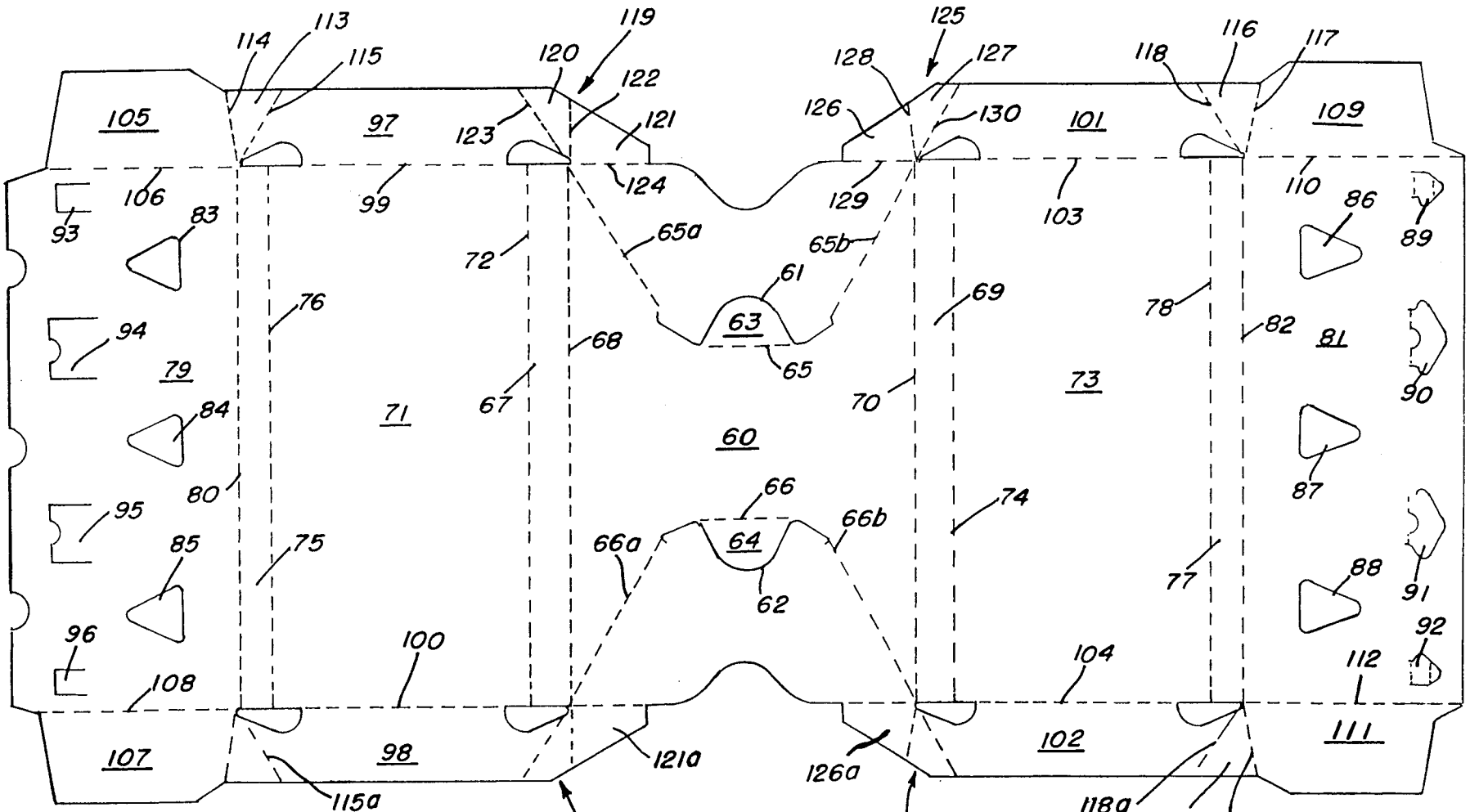
FIG. 4 is a plan view of a blank formed according to another form of this invention and which is viewed from the outside of the blank.
Figure 5:
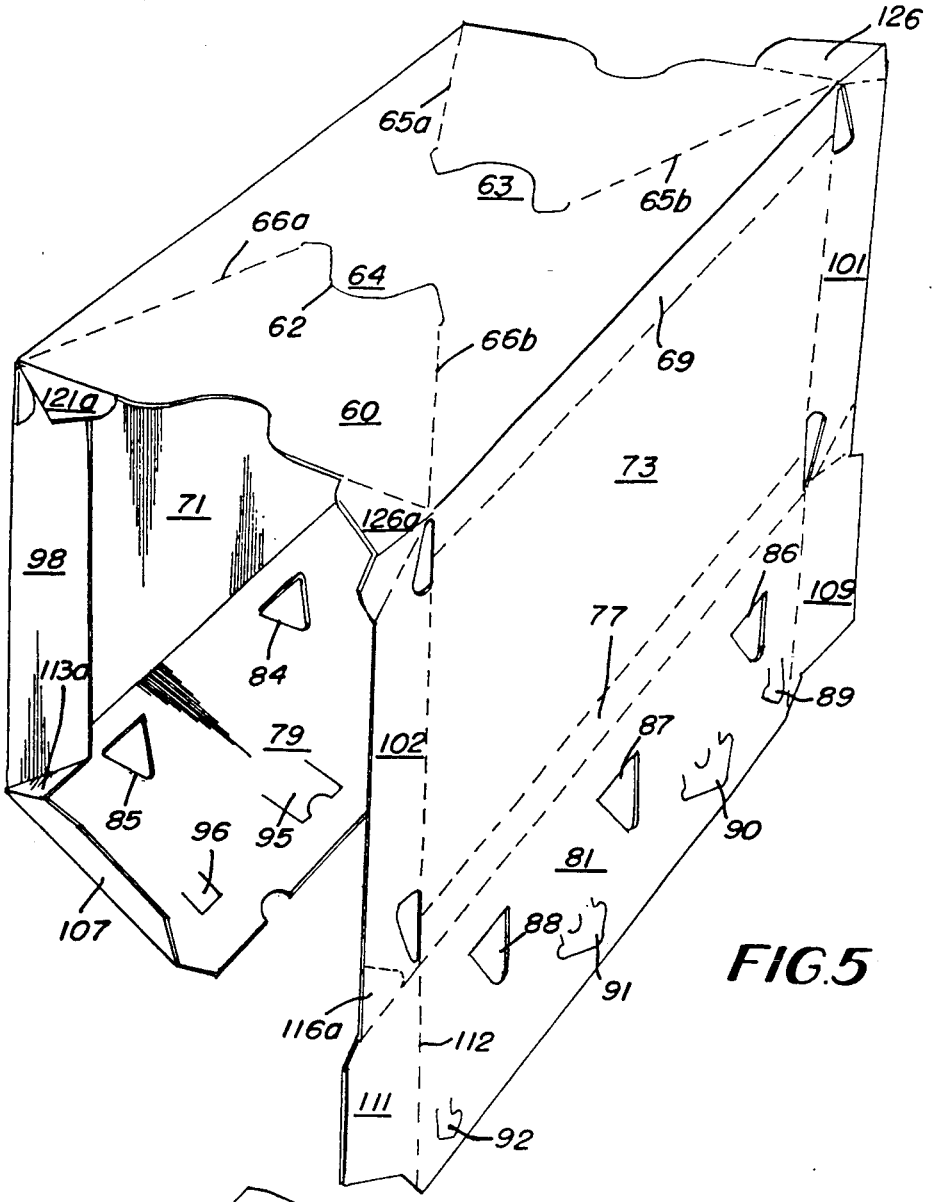
FIG. 5 is a view similar to FIG. 2 but which shows the blank of FIG. 4 during an intermediate stage of package formation and which omits the cans for clarity.
Figure 6:
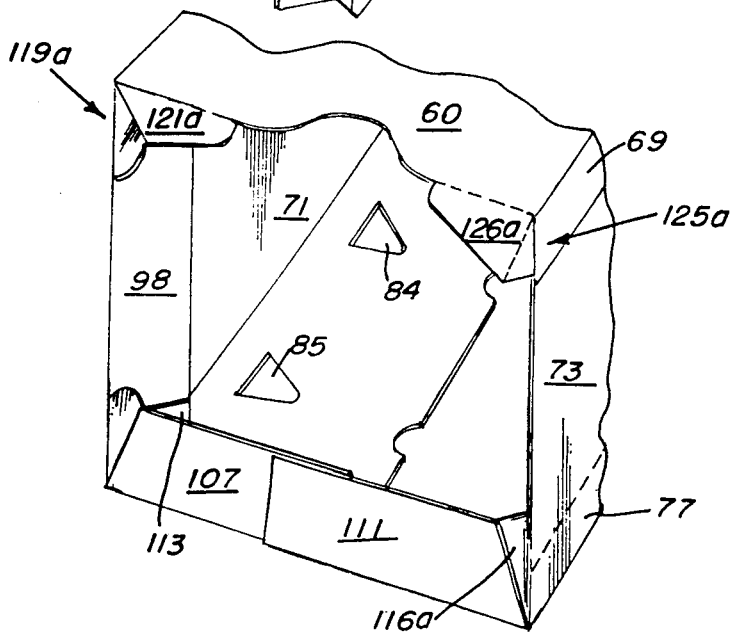
FIG. 6 is a view similar to FIG. 3 which shows in perspective one end of a finished carton formed from the blank of FIG. 4 and which omits the packaged cans for clarity.

The modification of the invention as shown in FIGS. 4, 5 and 6 includes a top wall 60 in which finger receiving apertures 61 and 62 are normally closed by tabs 63 and 64 which are foldably joined to top wall 60 along fold lines 65 and 66. Relief scores 65*a* and 65*b* and 66*a* and 66*b* are formed in top wall 60 and function in known manner.

Bevel panel 67 is foldably joined to top wall 60 along fold line 68 and bevel panel 69 is foldably joined to top wall 60 along fold line 70. Side wall 71 is foldably joined to bevel panel 67 along a fold line 72 and side wall 73 is foldably joined to bevel panel 69 along fold line 74.

Bevel panel 75 is foldably joined t side wall 71 along fold line 76 and bevel panel 77 is foldably joined to side wall 73 along fold line 78. The lap panel 79 is foldably joined to bevel panel 75 along fold line 80 and lap panel 81 is foldably joined to bevel panel 77 along fold line 82.

Conventional tightening apertures 83, 84 and 85 are formed in lap panel 79 while conventional tightening apertures 86, 87 and 88 are formed in lap panel 81. Conventional locking tabs 89–92 are conventional and cooperate with the apertures defined by retaining tabs 93–96. Anchoring panels 97 and 98 are foldably joined to the end edges of side wall 71 along fold line 99 and 100 respectively. Similarly anchoring panels 101 and 102 are foldably joined to side wall 73 along fold lines 103 and 104 respectively. Masking panel 105 is foldably joined to lap panel 79 along fold line 106 and masking panel 107 is foldably joined to lap panel 79 along fold line 108.

Similarly masking panel 109 is foldably joined to lap panel 81 along fold line 110 and masking panel 111 is foldably joined to lap panel 81 along fold line 112.

Web structure 113 is foldably joined to masking panel 105 along fold line 114 and to anchoring panel 97 along fold line 115. Similarly web structure 116 is foldably joined to masking panel 109 along fold line 117 and to anchoring panel 101 along fold line 118.

Web structure generally designated at 119 includes web panel 120 and 121 which are separated from each other by fold line 122. Web panel 120 is foldably joined to anchoring panel 97 along fold line 123 and web panel 121 is foldably joined to top wall 60 along fold line 124.

In like fashion, web structure generally designated at 125 includes web panel 126 and 127 which are separated by a fold line 128. Web panel 126 is foldably joined to top wall 60 along fold line 129 while web panel 127 is foldably joined to anchoring panel 101 along fold line 130.

On the other side of the blank, web panel designated 113*a* corresponds to web panel 113 and fold lines 114*a* and 115*a* correspond with fold lines 114 and 115. Likewise web panel 116*a* corresponds with web panel 116 and fold lines 117*a* and 118*a* correspond with fold lines 117 and 118 respectively. The web structure generally designated at 119 is identical to that designated 119*a* while web structure generally designated 125 is identical to that designated 125*a*.

For purposes of understanding the claimed invention, it should be understood that bevel panels 67 and 75 are deemed to constitute integral elements of side wall 71 and in like fashion bevel panel 69 and 77 are deemed to be integral parts of side wall 73.

In order to form a completed package using the blank shown in FIG. 4, a group of six cans arranged in two rows of three cans each is assembled and the blank of FIG. 4 is lowered so that the top wall 60 overlies the group of cans. Thereafter the side walls 71 and 73 are folded downwardly to the positions such as are indicated in FIG. 5. Thereafter the lap panels 79 and 81 are tightened by suitable machine elements which cooperate with the tightening apertures 83–88 and the locking tabs 89–92 are driven through the apertures defined by retaining tabs 93–96 respectively. With the composite bottom of the carrier thus formed, the masking panels 107 and 111 are manipulated into the positions shown in FIG. 6 due to the action of the web structures 113*a* and 116*a* and the inner ends of the masking panels are overlapped as shown in FIG. 6. Thus the masking panels serve to overlie the price indicia which may be formed on the outer surface of the can walls so as to render those indicia ineffective and to make possible the use of proper pricing indicia applied to an outer surface of one of the wrapper panels such as lap panels 79 and 81.

I claim:

1. A carton formed from a unitary blank for packaging a plurality of cans and comprising a top wall, side walls foldably joined along their top edges respectively to opposite side edges of said top wall, a pair of lap panels foldably joined respectively to the bottom edges of said side walls and secured together in overlapping relation to form a composite bottom wall of the carton, an anchoring panel foldably joined to each end edge of each side wall and folded into flat face contacting relation with the inner surface of the associated side wall, a masking panel foldably joined to each end edge of each of said lap panels and arranged with the inner edges thereof disposed in overlapping relation at each end of the carton, and web structure foldably joined along one edge thereof to the adjacent edge of the associated anchoring panel and foldably joined along another edge thereof to the adjacent end of the associated masking panel.

2. A carton according to claim 1 wherein said web structure comprises a generally triangular panel disposed in flat face contacting relation with the associated anchoring panel.

3. A carton according to claim 2 wherein a generally rectangular panel is foldably joined along one edge thereof to an edge of the associated triangular panel and along a generally parallel opposite edge thereof to the adjacent end edge of the associated masking panel.

4. A carton according to claim 2 wherein one edge of said triangular panel is foldably joined to the adjacent edge of the associated anchoring panel and another edge of said triangular panel is foldably joined to the adjacent end edge of the associated masking panel.

5. A carton according to claim 3 wherein said generally rectangular panel is disposed astride the adjacent corner of the carton and in engagement with the side wall of the adjacent can.

6. A carton according to claim 5 wherein the adjacent corner of the associated lap panel is cutaway along a diagonal cut line which is in general coincidence with the lower edge of said generally rectangular panel.

7. A carton according to claim 1 wherein a lower edge portion of said anchoring panel is generally parallel with the bottom edge of the associated side wall.

* * * * *